US010330425B2

(12) United States Patent
Missel

(10) Patent No.: US 10,330,425 B2
(45) **Date of Patent: *Jun. 25, 2019**

(54) UNCONVENTIONAL COMPACT COMPOUND BOW

(71) Applicant: Jonathan William Missel, Honeoye Falls, NY (US)

(72) Inventor: Jonathan William Missel, Honeoye Falls, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/344,741

(22) Filed: Nov. 7, 2016

(65) Prior Publication Data

US 2017/0122690 A1 May 4, 2017

Related U.S. Application Data

(63) Continuation of application No. 14/925,160, filed on Oct. 28, 2015, now Pat. No. 9,513,079.

(51) Int. Cl.

| | |
|---|---|
| ***F41B 5/10*** | (2006.01) |
| ***F41B 5/12*** | (2006.01) |
| ***F41B 5/14*** | (2006.01) |
| ***F41G 1/467*** | (2006.01) |

(52) U.S. Cl.

CPC ..... *F41B 5/10* (2013.01); *F41B 5/105* (2013.01); *F41B 5/123* (2013.01); *F41B 5/1403* (2013.01); *F41B 5/143* (2013.01); *F41B 5/1426* (2013.01); *F41G 1/467* (2013.01)

(58) Field of Classification Search

CPC ..... F41B 5/10; F41B 5/0094; F41B 5/105; F41B 5/1403; F41B 5/1426; F41B 5/143; F41G 1/467

See application file for complete search history.

(56) References Cited

U.S. PATENT DOCUMENTS

| | | | | |
|---|---|---|---|---|
| 2,982,279 A | | 5/1961 | Pursley | |
| 3,055,353 A | | 9/1962 | Perrucci | |
| 3,561,418 A | * | 2/1971 | Fredrickson | F41B 5/14 124/24.1 |
| 4,457,287 A | | 7/1984 | Babington | |
| 4,603,676 A | | 8/1986 | Luoma | |
| 4,662,344 A | * | 5/1987 | Mitchell | F41B 3/02 124/22 |
| 4,947,822 A | * | 8/1990 | Jones | F41B 5/12 124/25 |
| 4,957,093 A | * | 9/1990 | Hamlett | F41B 5/14 124/23.1 |
| 4,976,250 A | | 12/1990 | Jeffrey | |
| 5,243,957 A | | 9/1993 | Neilson | |

(Continued)

*Primary Examiner* — Melba Bumgarner
*Assistant Examiner* — Amir A Klayman
(74) *Attorney, Agent, or Firm* — Preston P. Frischknecht; Project CIP

(57) ABSTRACT

The device of the present invention employs a riser, bow limbs, and bowstring to shoot an arrow. The employed features are positioned horizontally relative to the ground and generally perpendicular to the device handle when in use. The device handle may be hinged, and is hinged in the same plane as the riser, bow limbs, and bowstring. The device handle is ambidextrous and may include an arm brace. The device handle may be adjusted to alter draw length, and the device limb pockets may be adjusted to alter draw weight. The device is completely user-adjustable, compact, and lightweight.

17 Claims, 16 Drawing Sheets

(56) References Cited

U.S. PATENT DOCUMENTS 5,623,915 A * 4/1997 Kudlacek ..... F41B 5/10 124/25.6
5,632,262 A * 5/1997 Hanson ..... F41B 3/02 124/20.1
5,720,268 A * 2/1998 Koltze ..... F41B 5/0094 124/23.1
5,853,001 A * 12/1998 Vyprachticky ..... F41B 5/14 124/88
6,371,098 B1 4/2002 Winther
6,715,481 B1 * 4/2004 Anderson ..... F41B 5/10 124/23.1
6,729,320 B1 5/2004 Terry
6,763,818 B2 * 7/2004 Larson ..... F41B 5/10 124/25.6
7,066,165 B2 6/2006 Perry
7,743,760 B2 6/2010 Woodland
7,823,572 B2 * 11/2010 Anderson ..... F41B 5/123 124/25
8,622,050 B2 1/2014 Goff et al.
8,656,899 B2 2/2014 Bednar et al.
8,776,770 B2 7/2014 Batdorf
8,919,332 B2 * 12/2014 Trpkovski ..... F41B 5/0094 124/23.1
8,991,380 B2 3/2015 Bednar et al.
8,997,728 B2 * 4/2015 Popov ..... F41B 5/0094 124/25.6
9,255,756 B1 * 2/2016 Wu ..... F41B 5/123
9,297,604 B1 * 3/2016 Sidebottom ..... F41B 5/123
2005/0279338 A1 * 12/2005 Dziekan ..... F41B 5/12 124/25
2007/0044782 A1 * 3/2007 Norkus ..... F41B 5/0094 124/25.6
2012/0204850 A1 * 8/2012 Okupniak ..... F41B 5/10 124/25.6
2013/0042848 A1 2/2013 Trpkovski
2013/0112182 A1 5/2013 Martin
2014/0238372 A1 * 8/2014 Chirico ..... F41B 5/10 124/25.6
2015/0153131 A1 6/2015 Trpkovski
2015/0226512 A1 * 8/2015 Butsook ..... F41B 5/143 124/20.3
2016/0313084 A1 * 10/2016 Hunter ..... F41B 5/0031

* cited by examiner

UNCONVENTIONAL COMPACT COMPOUND BOW

CROSS-REFERENCES TO RELATED APPLICATIONS

This application relates to and claims priority from the following U.S. patent applications. This application is a continuation of application Ser. No. 14/925,160 filed Oct. 28, 2015, which is hereby incorporated by reference in its entirety.

BACKGROUND OF THE INVENTION

1. Field of the Invention

The present invention is generally directed to mechanical projectors, more specifically bows, compound bows, and compact compound bows.

2. Description of the Prior Art

SUMMARY OF THE INVENTION

The present invention is generally directed to mechanical projectors. The invention is further directed to a compound bow. Further still, the invention is directed to a compound bow that shoots in a generally horizontal plane, similar to a crossbow but with compound bow features and functions.

The present invention is further directed to a mechanical projectile device comprising a structural riser, a pair of flexible structural limbs, and a handle, wherein the pair of structural limbs is adjustably affixed to the structural riser, the handle is adjustably, pivotally affixed to the structural riser, and the pair of structural limbs and the handle cooperate to adjust a draw weight and a draw length of the mechanical projectile device.

These and other aspects of the present invention will become apparent to those skilled in the art after a reading of the following description of the preferred embodiment when considered with the drawings, as they support the claimed invention.

DETAILED DESCRIPTION

Figure 1:
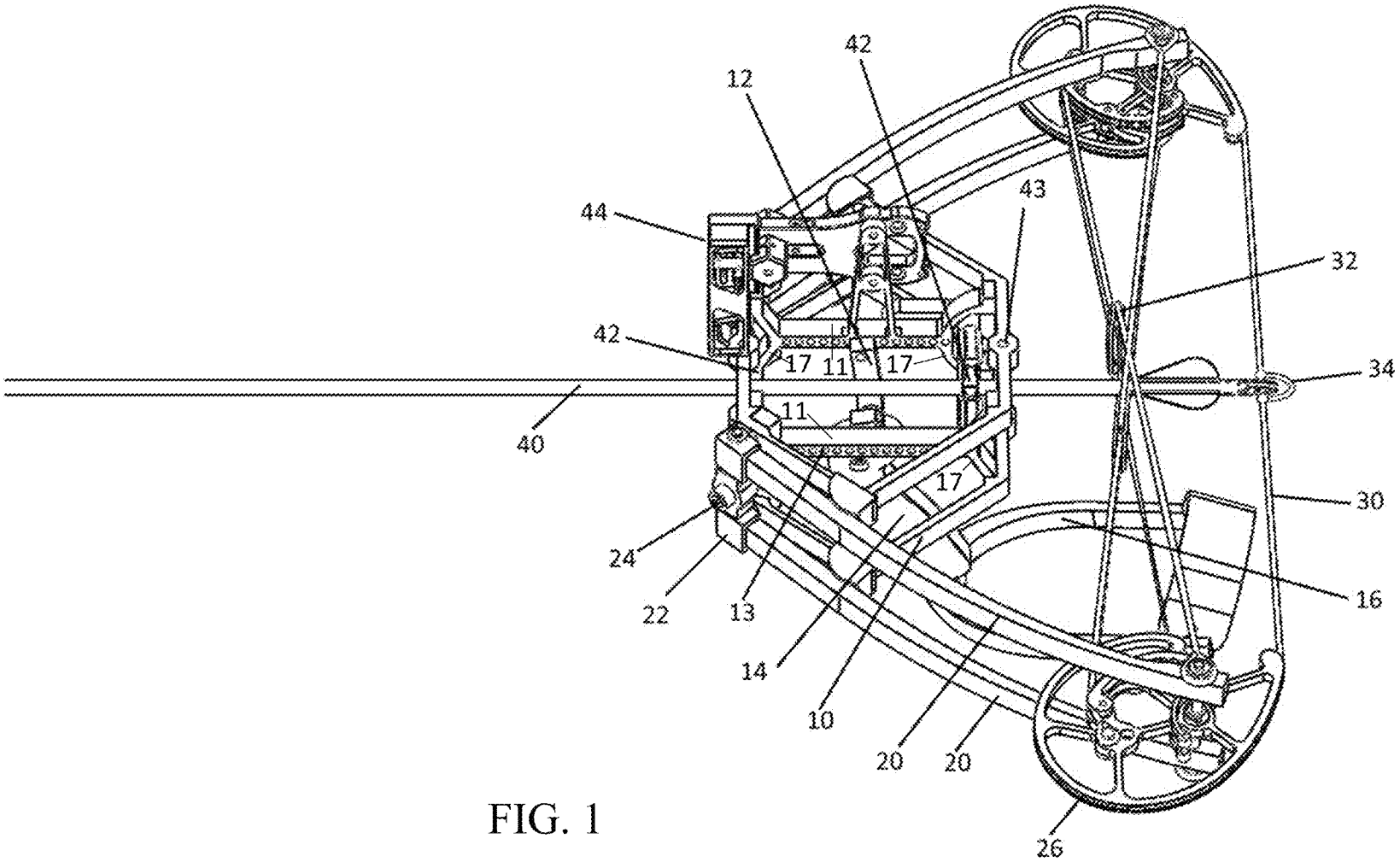
FIG. 1 illustrates a full, top-left perspective view image of the present invention.

The present invention is generally directed to mechanical projectors, specifically compound bows. The present invention includes a compound bow disposed in a generally horizontal plane, parallel to the ground, wherein the compound bow includes a structural riser, limbs, cam pulleys, cables, and a bowstring to form the projecting functional units of the compound bow. Further included are a handle, arm brace, arrow rest mounts, and sight mounts.

In a preferred embodiment, the main body of the present invention consists of two open-frame, structural members, or riser plates, that are horizontal and parallel to each other. Across embodiments, riser plates may be polygonal or curved. In one embodiment, each riser plate may be generally hexagonal in shape, having (from center top or bottom) one or more proximal distal, and/or equidistant vertices. One or more generally short, connecting, vertical structural members may be between and connect riser plates adjacent to the one or more vertices. Riser plates, with or without the short, vertical structural members, may form a scaffolding that is substantially polyhedral, curved, or otherwise shaped, the scaffolding further having a riser interior volume. More specifically, the scaffolding forms a riser with a substantially hollow interior volume that is framed and/or bounded by riser plates and/or connecting, vertical structural members. In one embodiment, one or more linear horizontal structural members, herein termed pivot bars or rails, are mounted within the interior volume by mounting brackets at each end to the riser plates adjacent to the one or more vertices; the pivot bars extend between the short, vertical structural members such that two exterior triangles and one interior rectangle may be created within the riser plates. Disposed between the two riser plates is an arrow rest. On both the front edge and the back edge of pivot bars may be mounts, wherein the mounts removably, adjustably provide optional mounting points for accessories such as sights, scopes and arrow rests, wherein the back edge is toward the archer. Disposed between pivot bars is an ambidextrous handle, wherein the top end of the handle is adjustable between the front edge and the back edge of the riser plates along the (pivot bar) through an array of selectable mounting points, preferably two mounting points. Preferably, the handle attachment or yoke is U-shaped to allow clearance for a projectile. The pivot axle hole in the yoke is offset by ¼ the distance between the array of mounting positions in the pivot bars. This doubles the resolution of the adjustable handle by having the option to flip it around by rotating the rotatable yoke 180 degrees. In a preferred embodiment, the adjustment positions are spaced ¼" apart and the yoke hole is offset by 1/16", making the effective draw length adjustment resolution ⅛". Affixed to the bottom end of the handle is a rotatable arm brace. The arm brace strap can be adjusted to accommodate various sizes. The structure of the arm brace can be secured at any angle in the plane whose normal is the general axis of the handle to accommodate arm position. In one embodiment, the arm brace is secured using a screw. Preferably, the arm brace can be adjusted by loosening the screw, moving the arm brace to the desired position, and re-securing the screw. Adjustably affixed along the front edge of one or more riser plates are flexible members or limbs that are parallel to each other and at the same distance as the riser plate to which they are affixed. Rotationally affixed at the opposite end of and between the flexible members are cam pulleys, which are connected by a linear, flexible, high-gauge, braided member, which is wrapped around at least a portion of both cam pulleys.

In a preferred embodiment, the riser plates are secured to each other by two sets of multifunctional crossmembers. One set serves to affix the riser plates and mount the limb pockets via the limb adjustment screws. The second set serves to affix the riser plates, provide structural rigidity to the open framed riser plates, and provide mounting points options for the handle and accessories. Disposed along the riser plates, at each of the four intersections with the vertical plane of symmetry, are optional mounting point options for accessories, such as sights, scopes, arrow rests, ballast weights, etc. These accessories may also be mounted to the adjustable handle mount members, either directly, or indirectly, through brackets.

The space between the riser plates, in cooperation with an arrow rest, provide for an opening through which an arrow may be shot. This general riser configuration a shoot-through riser. The present invention cooperates with an accessory arrow rest which holds the arrow directly centered. Providing a shoot-through riser system with a double-sided, open-frame design, like the present invention, affords more equally and symmetrically distributed transmission of force upon shooting for maximum accuracy, energy transfer efficiency and projectile speed. The riser design has several optional arrow rest mounting points, including the front or the back of the riser, to accommodate various arrow rests and a wide range of arrow lengths. This adaptive design is meant to support the personal preferences of the user.

The double-sided, open-frame riser in coordination with a centered arrow rest is perfectly symmetrical, allowing for the transfer of force from bowstring to limbs to riser to be evenly distributed across the riser. The forces act largely in the plane of the riser plate members, efficiently reducing the torsional structural stresses present in traditional cut-away riser, and allowing for a very lightweight design. The symmetry of the double-sided riser also reduces uneven limb deflection and cam lean, affording a more uniform distribution of energy transfer, improved accuracy when firing, and reduced risk of the string jumping off the cam pulley. The shape of the double-sided, open-frame riser, compared to the traditional linear riser of a compound bow, is more resistant to deflection from the forces applied to it during shooting. The shape reduces structural demands on the riser, thereby reducing the need for structural reinforcement, allowing for thinner members, and making the overall bow much lighter weight. Preferably, the riser of the present invention is made of aluminum. Alternatively, the riser may be made of any suitable composite, such as carbon fiber, or a metal with high strength-to-weight ratio. The single, linear riser of a traditional compound bow may bend or break with excess force, cycled loads, or fatigue; thus, traditional compound bows need substantial reinforcement. The closed-loop shape of the present invention is stronger and more enduring than straight risers.

In an alternative embodiment, the horizontally parallel, double-sided riser may be any shape, for example and not limitation, triangular, pentagonal, or any combination thereof. The riser shape does not need to be a polygon, as its design should ultimately be dictated by the desired features, function and performance of the bow, for example: limb angle, axle-to-axle distance, and component mounting. Further, the principles of this invention do not necessitate a riser with a closed shape; in one embodiment, the riser may have an open shape or a partially open shape. In yet another embodiment, the horizontal riser may not be double-sided, albeit including a bore through which the arrow may be shot, preserving the shoot-through riser characteristics and functions. Similarly, the limbs may be solid, versus split.

The handle preferably is positioned to rotate in a vertical plane that intersects the arrow to provide for balanced grip. Mounting the handle off the riser, as such, has several advantages, including eliminating the need for an arm guard to protect the archer from the bowstring. The extended axle of the pivoting handle intersects the arrow perpendicularly. Handle mount adjustment is in the direction of the arrow, spanning a range between the front of the riser and the back. The drawn bow's mass is preferably balanced about the pivot of the handle. Balancing can typically be achieved with intentional configuration of the accessories, such as arrow rest and sights, but can also be achieved through ballast massed if desired. Further, the handle is completely ambidextrous and symmetrical relative to the riser; no adjustments are necessary for left- or right-handedness, unlike other ambidextrous handles in the prior art that require grip adjustments, for example, for complete ambidexterity. The arm brace can be rotated to fit the preference of the user, and these preferences frequently fall into two ranges, defined by handedness.

A ¼"×20 threaded hole is included under the handle or arm brace to fit a monopod, bipod or tripod. This provides an optional aid in steadying the projector while aiming. Alternatively, the arm brace may be rested directly on an object like a log, gun rail, tree branch or rock, to steady the device. Neither of these methods are present in the prior art for vertical bows. Further, the arm brace, including the brace support and brace pad, provide enhanced stabilization while holding and shooting the bow by counteracting the torque created when drawing the bow. If not for the arm brace, the draw weight of the bow would be severely limited by the strength of the wrist to counteract the torque created upon drawing the bow.

In a preferred embodiment, the handle pivots around a horizontal axis perpendicular to the length of the arrow. This pivoting is provided by the adjustment holes in the linear, horizontal structural cross members of the riser. Pivoting mechanically eliminates the ability of the archer to draw the bowstring out of plane from the flexing limbs—a classic and natural technique problem called "torqueing." By pivoting, and balancing the drawn bow about that pivot, the bowstring does not deflect in a direction normal to the plane of the riser and torqueing is reduced, or more preferably, effectively eliminated. Reduced or effectively eliminated torqueing creates a more efficient, consistent and accurate shot. Further, bowstring alignment with respect to the riser, limbs, cams and cables does not change no matter the shooting angle, as there is no torqueing. Further still, the pivot is mechanically designed in cooperation with the geometric center of the shoot-through riser to strategically eliminate torqueing.

Preferably, the angle between the handle and the horizontal plane of the riser is adjustable between about 160 degrees and about 0 degrees. In another embodiment, the angle between the handle and the horizontal plane of the riser is adjustable between about 85 degrees and about 5 degrees. In another embodiment, the angle between the handle and the horizontal plane of the riser is adjustable between about 80 degrees and about 10 degrees. In another embodiment, the angle between the handle and the horizontal plane of the riser is adjustable between about 75 degrees and about 15 degrees. In another embodiment, the angle between the handle and the horizontal plane of the riser is adjustable between about 70 degrees and about 20 degrees. In another embodiment, the angle between the handle and the horizontal plane of the riser is adjustable between about 65 degrees and about 25 degrees. In another embodiment, the angle between the handle and the horizontal plane of the riser is adjustable between about 60 degrees and about 30 degrees. The angle between the handle and the horizontal plane of the riser can be adjustable anywhere between about 160 degrees and about 0 degrees, including the embodiments listed above, and as one of ordinary skill in the art would recognize, any range between about 160 degrees and 0 degrees. The handle pivoting towards the horizontal plane of the riser is advantageous over the prior art in that it provides for a more compact bow. The variety of angles that can be formed between the handle and the horizontal plane of the riser provide for a variety of positions which effectively eliminate torqueing. This provides for a user to shoot from more angles and positions while eliminating the adverse effects of torqueing.

The compact bow of the present invention is also advantageous with respect to storage, carrying (such as in a backpack), avoiding obstacles when shooting, etc. In a preferred embodiment, the handle is adjustable forward and backward along the riser. By adjusting the handle position, the archer correspondingly adjusts the functional draw length of the bow. The handle adjustment preferably is in increments of ⅛", which is accomplished by having pivot bar holes spaced ¼" apart and a handle yoke with a pivot hole 1/16" off-center, thereby allowing the handle yoke to be rotated 180 degrees to provide 1/16" extension in front of or behind each pivot bar hole. The elegance of this design feature is that the functional bow remains undisturbed while the handle is moved to change the draw length. Adjusting the handle position requires little effort, and this provides for multiple users to use the same bow. Preferably, the draw length can also be adjusted without tools. Changing the effective draw length does not require any adjustment of the arrow, arrow rest, sights, limbs, cables, cams, cam modules or bowstring. In one embodiment, nothing in the bow must be disassembled to change the draw length. Advantageously, the draw length can be adjusted in real time or in near real time. In one embodiment of the present invention, the draw length can be adjusted from about 25.5 inches to about 29.125 inches. The present invention lends itself to embodiments designed for any practical range of draw lengths, including but not limited to, from about 22 inches to about 27 inches, from about 23 inches to about 28 inches, from about 24 inches to about 29 inches, from about 25 inches to about 30 inches, and any combination thereof.

In an alternative embodiment, the pivot bar holes are spaced about ⅓" apart. In another alternative embodiment, the riser holes are spaced about ⅕" apart. In yet another alternative embodiment, the pivot bar holes are spaced between about 0.508 and about 0.847 cm. Further, an alternative embodiment includes open square spaces to allow for handle connection. Further still, an alternative embodiment includes handle connections that lock in place. Further still, separate alternative embodiments contain a pivot hole on the handle yoke that is 1/14", 1/15", and 1/17" off-center. Alternative embodiments use other mechanical methods for adjusting the location of the pivoting handle, such as guide rails and clamps and cantilevered struts with setscrews. Other mechanisms for adjusting the location of the pivoting handle are envisioned and within the scope of the present invention.

In an alternative embodiment, the handle pivots with respect to an axis perpendicular to the horizontal structural riser. In one embodiment, the handle mounts to the device via a biaxial gimbal, thus providing rotation of the compound bow in the horizontal and vertical planes. In yet another embodiment, the handle of the device pivotally attaches to the riser via a tri-axial gimbal or a mechanical ball-and-socket joint, thus providing multi-axial rotation of the bow with respect to the handle. The handle mount may be U-shaped or any other shape that allows the handle to be positioned out of the arrow's path, thus affording a clear avenue for shooting.

Specifications, such as draw weight, are independently adjusted from draw length. Draw weight is preferably altered to match an archer's strength. To adjust the functional draw weight, the screws affixing the limbs to the riser are loosened or tightened. Compound bows in the prior art typically have draw weight ranges of about 10 pounds. For example, a 75 pound draw weight could be adjusted down to 65 pound. The compound bow of the present invention preferably has a highly adjustable draw weight range between about 5 and about 40 pounds. More preferably, the compound bow of the present invention has a draw weight range of about 40 pounds. This is a design feature of the riser and limb pockets. An example embodiment has a draw weight that can be adjusted continuously between about 25 and about 65 pounds, thereby allowing a large adult and a small child to use the same bow. In other embodiments, the draw weight can be adjusted to be as low as 10 pounds, 15 pounds, 20 pounds, 25 pounds, 30 pounds, 35 pounds, or 40 pounds, and as high as 45 pounds, 50 pounds, 55 pounds, 60 pounds, 70 pounds, 75 pounds or 80 pounds. The compound bow of the present invention is, therefore, completely adjustable. Further, the design is such that these adjustments do not require the aid of a bow press.

Notably, the compound bow of the present invention has a bow speed of about 300 feet per second using an approximately 55 pound draw weight and an arrow weight of about 268 grains.

In a preferred embodiment, the limbs are adjustably attached to the riser via adjustment screws in the limb pockets. These adjustment screws are loosened and tightened to change the preloaded of the limbs and ultimately the draw weight, according to the user's desire. In one embodiment, the adjustment screws span about 0.1-3 inches long. Preferably, the adjustment screws span about 0.1-1.75 inches long. Alternatively, the adjustment screws are between about 0.5 inches and about 1.5 inches long. In another embodiment, the adjustment screws are between about 1 inch and 1.5 inches long. In yet another embodiment, the adjustment screws are between about 1.5 inches and 2.5 inches long. In one embodiment, the adjustment screw spans about 1.5 inches. When the screws are loosened, the bowstring is slackened and cam, cable and bowstring adjustments can be made as tuning and timing work is needed. In this way, adjustments can be made without a bow press. In the prior art, limbs may be adjustable, but if the screws are loosened to the point where the screws come out, the bow will come apart because of the flex in the limbs.

However, the screws of the present invention are preferably long enough so that the limb pocket screws can be unscrewed completely or removed. This is advantageous as it allows the bow to be taken apart without specialized equipment, and also reduces or eliminates the risk of injury from taking apart the bow. Affixed to the ends of both sets of parallel split limbs, opposite the ends secured by the limb pockets, are radial cam pulleys; there is one cam pulley for each set of split limbs. Connecting the two cams are a bowstring and four cables. On the cables are cable spreaders. In a preferred embodiment of the present invention, the cam pulleys operate using a twin cam (also called two cam or dual cam) system. Alternatively, the cam arrangement can be customized to suit the archer's or manufacturer's preferences. By way of example and not limitation, other cam types that can be used include hybrid, single, or binary cams.

In a preferred embodiment, four cables are used along with cable spreaders. The cable spreaders serve two purposes: to feed the cables into the cam module channels in the plane of the module channels, and spread out the cables such that the arrow can pass between them without interference. With single or two cable systems, the cable often needs to be held away from the arrow's path by a system of sliders or pulleys. This is done off center, meaning that the cables, which function to flex the limbs, are not symmetrically flexing the limbs, causing them to perform differently and fatigue. The unbalanced flexing is often masked by adjusting the aim to compensate for poor arrow flight, which ultimately results in less efficient, less smooth, less accurate designs. Therefore, the four cable design, in conjunction with the cable spreaders, allows both sets of limbs to flex the same and prevent limb leaning. An alternative embodiment does not use cable spreaders with the four cable system. Yet another embodiment uses cable spreaders that do not bring the cables in the plane of the cam module channels. Alternative embodiments use cable systems that correspond to alternative cam systems and may or may not use cable spreaders. Those skilled in the art will recognize the advantages and disadvantages of applying various cam and cable systems to this bow and understand that the scope of this invention is not limited to any specific cable or cam system, or the use of cable spreaders.

Solid limb advocates propose that solid limbs offer better torsional stiffness and are more accurate than split limbs. Split limb advocates propose that split limbs are more durable and produced less hand-shock than solid limbs. Limb materials, technologies, and composites continue to improve, thereby reducing the strength of either advocate's proposition. However, the preferred embodiment of the present invention uses a split limb style, so that reaction forces from the limbs are more directly converted to in-plane stresses in the riser plates. In an alternative embodiment, the limbs are solid, albeit containing a slit for cam pulley insertion, attachment, and rotation. Alternative embodiments include solid limbs or split limbs, the centers of which do not align with the riser plates. In these embodiments, it is recommended, but not required, that the limbs are affixed to the riser such that the reaction forces act through the center of the riser plates. In yet another embodiment, the compound bow includes one main riser structure, and the limbs are affixed out of the plane of the riser. In yet another embodiment, the compound bow includes one main riser structure and the limbs are affixed in the plane of the riser.

In a preferred embodiment, the length of the compound bow from axle to axle is between about 17 to 18 inches. Alternatively, the axle-to-axle length can be anywhere from about 17 inches to 20 inches. In another embodiment, the axle-to-axle length is between about 16 inches and 23 inches, or longer if desired. However, most preferably, the axle-to-axle length is about 17 inches. This preferred axle-to-axle length is about half that of most compound bows of prior art. A small bow is advantageous because it is easily maneuverable and interference from tree limbs, shooting rails, tree trunks and ground blinds is minimized when hunting. The small size is afforded by the geometry and design of the riser, cable, and cam systems. In one embodiment, the geometry of the riser is generally triangular in shape. In other embodiments, the geometry of the riser is rectangular, pentagonal, hexagonal, heptagonal, or octagonal. Additional embodiments do not have a closed shape. It is obvious to those skilled in the art that the general outline or shape of the riser is an open design variable that is not limited by the scope of this invention.

In a preferred embodiment, due to its compact size and efficient management of structural stresses, the weight of the present invention is between about 2.5 to 3.0 pounds. Alternatively, the weight is between about 2.0 to 2.5 pounds. In yet another alternative, the weight is between about 3.0 and 4.0 pounds. In yet another embodiment, the weight is between 3.0 pounds and 5.0 pounds. In another embodiment, the bow is approximately 3 pounds. In another embodiment, the bow is approximately 3.5 pounds. In a preferred embodiment, the bow is about 2.8 pounds.

Unlike a traditional, vertically-oriented compound bow, the nontraditional, horizontally-oriented compound bow of the present invention is much less likely to interfere with a ground blind, tree stand, or thick brush while being used to hunt. Although in the horizontal plane, this compound bow requires the same shooting mechanics of the traditional compound bow, allowing an archer to easily transfer his/her skills. Further, the horizontal structure provides a great alternative for disabled archers, specifically those who are wheelchair-bound, where a vertical bow would interfere.

FIG. 1 illustrates a preferred embodiment of the device of the present invention. The riser 10 is the central body of the device. Pivot bars 11 are mounted to the riser by mounting brackets 17. The pivot bars are co-planar and parallel with a projectile 40 loaded in the device and equidistant from the projectile, such that the force applied through the handle to the pivot bars is in line with the projectile's main axis (launch path). A handle 14 is attached to the riser 10 via a yoke 12, the handle being adjustably movable from the front to the back of the pivot bars 11 using pivot attachment holes 13. An arm brace 16 is attached to the handle. Affixed to the riser 10 are split limbs 20 via limb pockets 22. The split limbs 20 are adjustable by adjustable limb screws 24. At the opposite end of the split limbs 20 are cam pulleys 26. The cam pulleys 26 at each end of each split limb 20 are connected by bowstring 30. Centrally located in the bowstring 30 is a nock point 34 and a set of cable spreaders 32, which provide a window for the arrow 40 to shoot through. Supporting the arrow 40 and attached to the riser 10 is an arrow rest 42. A sight 44 is mounted to the riser via an accessory mount 43. Notably, unused pivot adjustment holes 13 can also serve to mount accessories. The vertical bar connecting the riser is in the vertical plane, although in the present invention, with a bend inward, which is preferable. Alternatively, the bar can be completely vertical, which would allow for more pivot adjustment holes 13 and a greater change in draw length, since draw length is a product of handle 14 adjustment (i.e. draw length can be affected without modifying bowstring, cam pulleys, or limbs).

Figure 2:
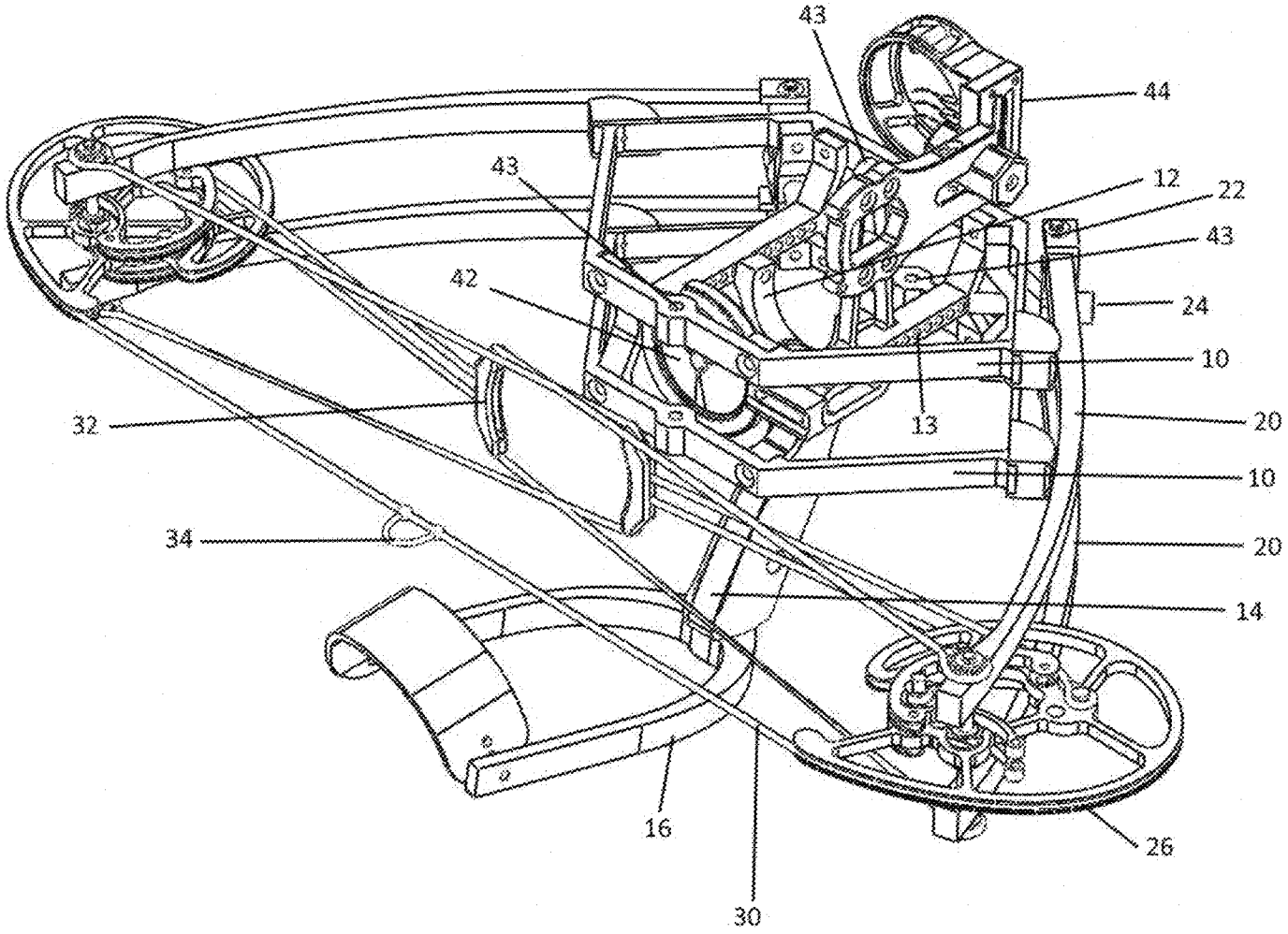
FIG. 2 illustrates a full, top-right perspective image of the present invention.

FIG. 2 illustrates a full, top-right perspective image of the present invention. The riser 10 is the central body of the device. A handle 14 is attached to the riser 10 via a handle yoke 12, the handle being adjustably movable from the front to the back of the riser 10 using pivot attachment holes 13. The yoke 12 also enables the handle to pivot using the pivot attachment holes 13. An arm brace 16 is attached to the handle. Affixed to the riser 10 are split limbs 20 via limb pockets 22. The split limbs 20 are adjustable by adjustable limb screws 24. At the opposite end of the split limbs 20 are cam pulleys 26. The cam pulleys 26 at each end of each split limb 20 are connected by bowstring 30. Centrally located on the bowstring 30 is a nock point 34. A set of cable spreaders 32 provide a window for the arrow to shoot through. Supporting an arrow within the riser 10 is an arrow rest 42. A sight 44 is mounted to the riser 10 via an accessory mount 43. The sights, arrow rest and any other accessory have several optional mounting points to accommodate various components and user preferences.

Figure 3:
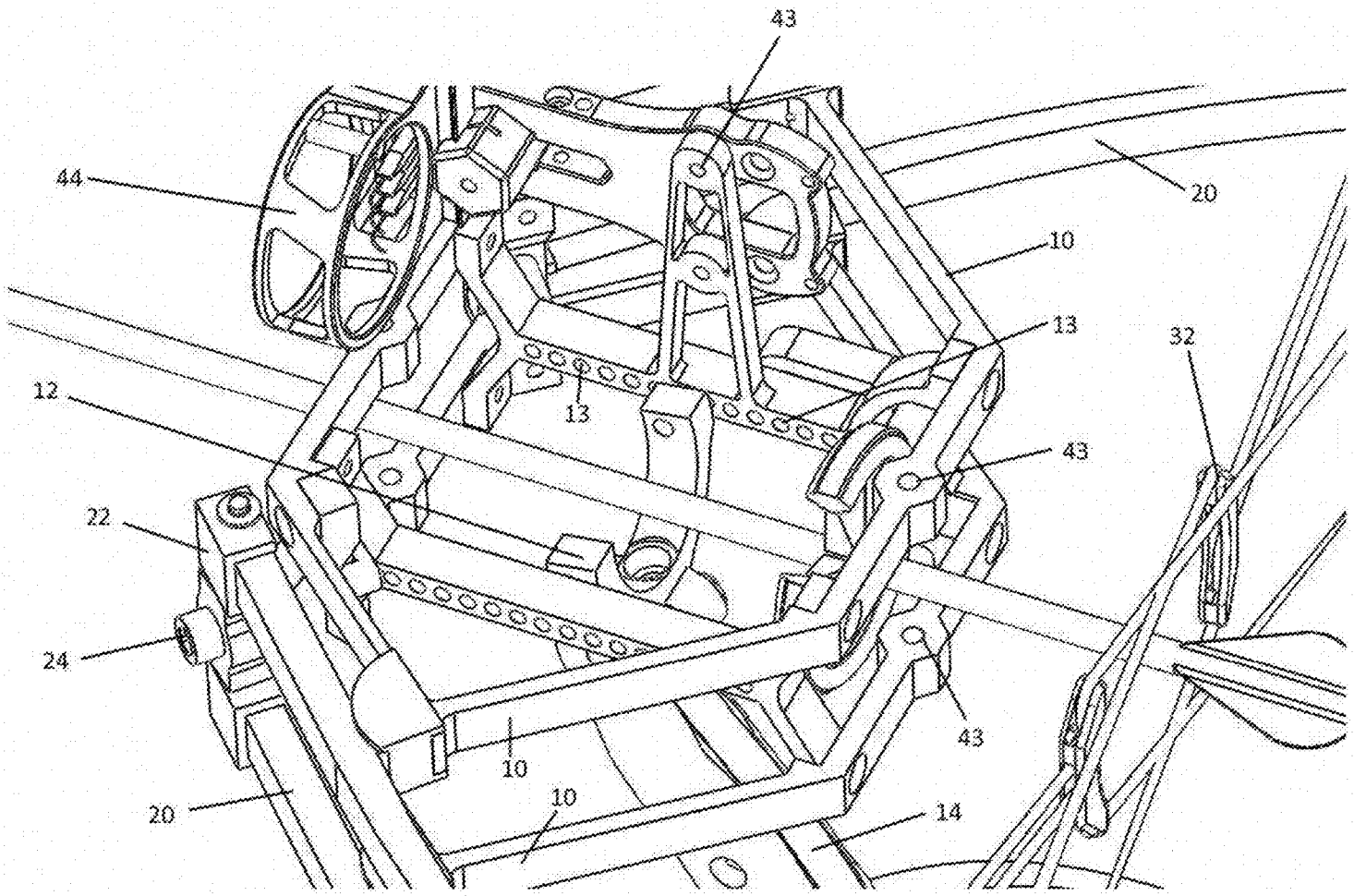
FIG. 3 illustrates a close up, top-left perspective view diagram of the riser, sight, and related components of the present invention.

FIG. 3 illustrates a close up, top-left perspective view diagram of the riser 10, sight 44, and related components of the present invention. Attached to the riser 10 is the handle via a yoke 12, the handle being adjustably movable from the front to the back of the riser 10 using pivot attachment holes 13. The split limbs 20 are adjustable by adjustable limb screws 24. Affixed to the riser 10 are split limbs 20 via limb pockets 22. A sight 44 is mounted to the riser 10. The sight is movable from the front to the back of the riser 10. The handle 14 is also depicted, as well as the cable spreaders 32 and accessory mounts 43.

Figure 4:
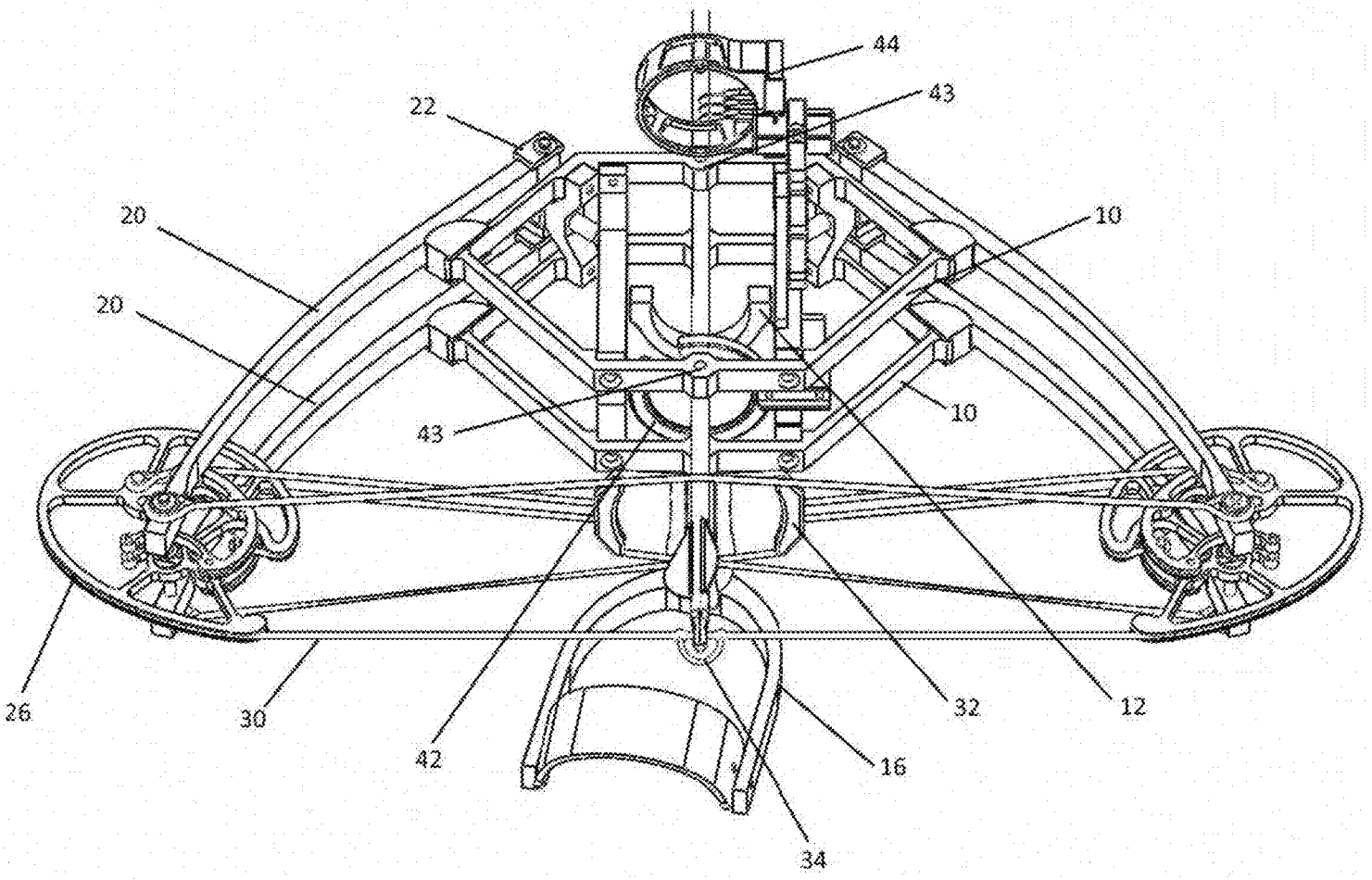
FIG. 4 illustrates a top, rear perspective view image of the present invention.

FIG. 4 illustrates a top-rear perspective view image of the present invention. The riser 10, yoke 12, arm brace 16, split limbs 20, cam pulleys 26, bowstring 30, cable spreaders 32, nock point 34, arrow rest 42, accessory mounts 43, and sight 44 are depicted in this view.

Figure 5:
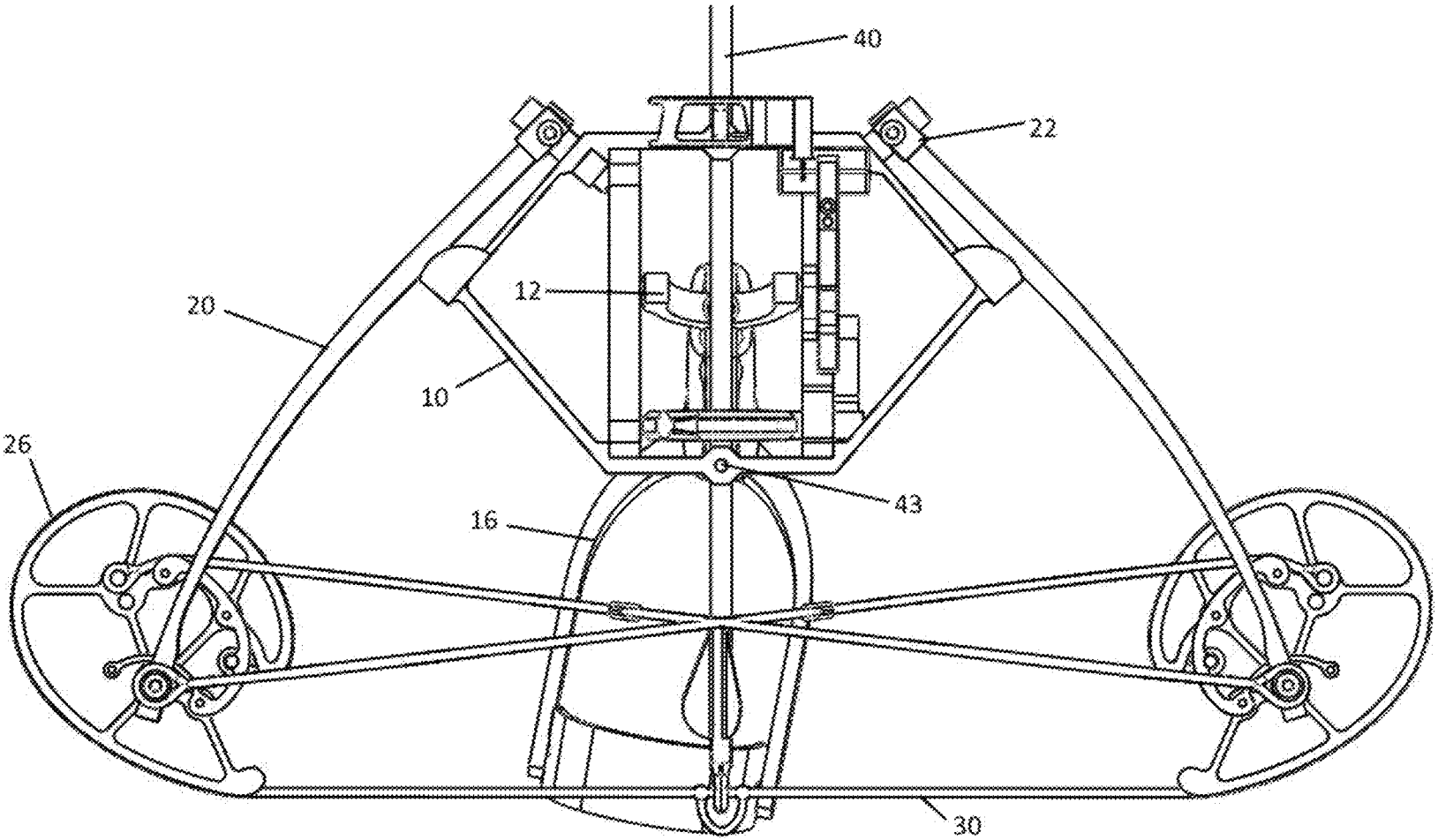
FIG. 5 illustrates a top perspective view image of the present invention.

FIG. 5 illustrates a top perspective view of the basic structure including an arm brace 16, riser 10, and limb pockets 22. The yoke 12 area is displayed next to the horizontal, linear members. Accessory mounts 43 are displayed at the front edge and back edge of the riser 10.

Figure 6:
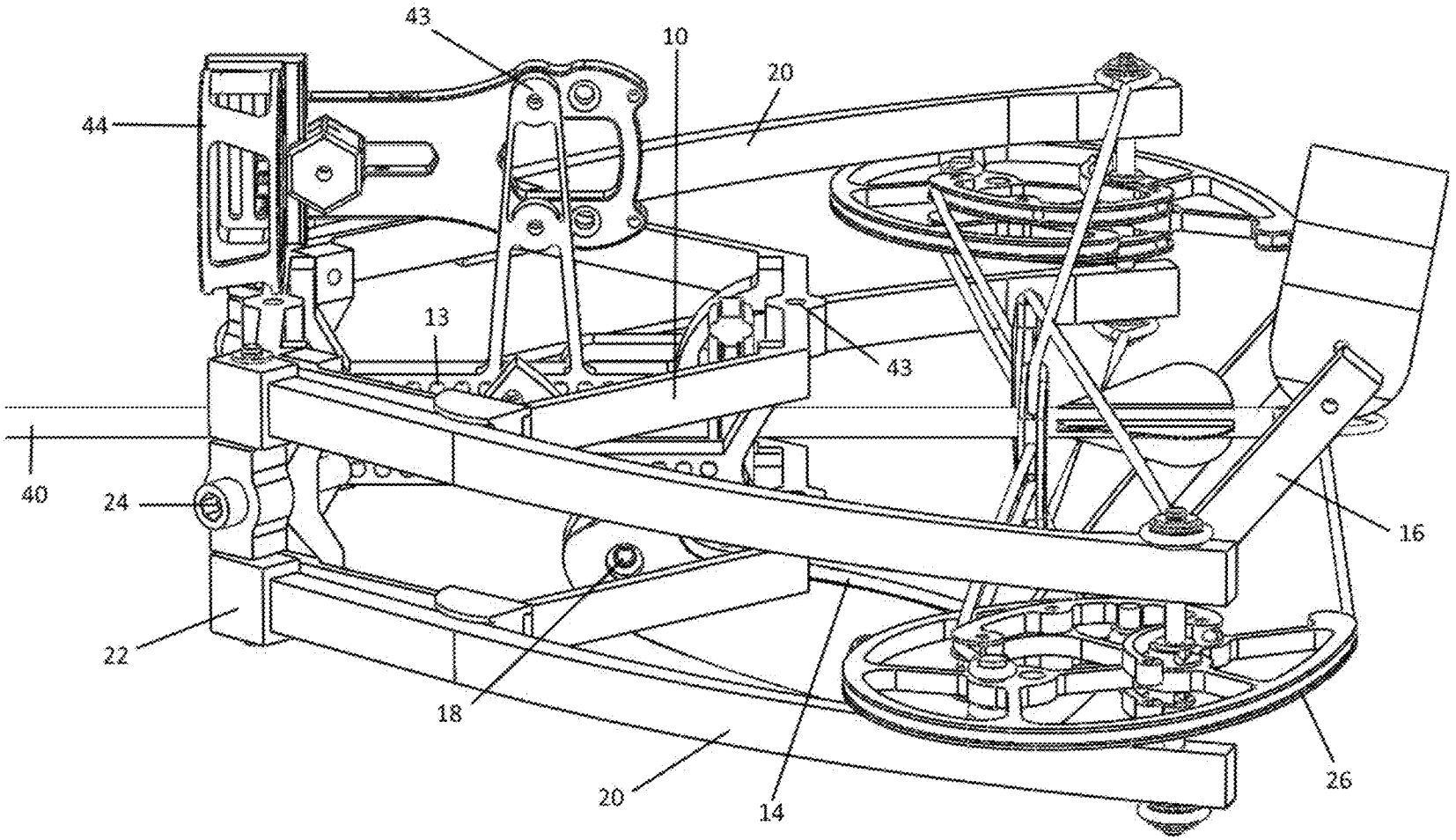
FIG. 6 illustrates a top-left, side perspective view image of the present invention.

FIG. 6 illustrates a side perspective view with the handle 14 fully pivoted toward the riser 10. The limb pockets 22, split limbs 20, and adjustable limb screw 24 confer complete adjustability and customizability of effective draw weight. The cam pulley 26 system is displayed at the opposite end from the limb pocket 22.

Figure 7:
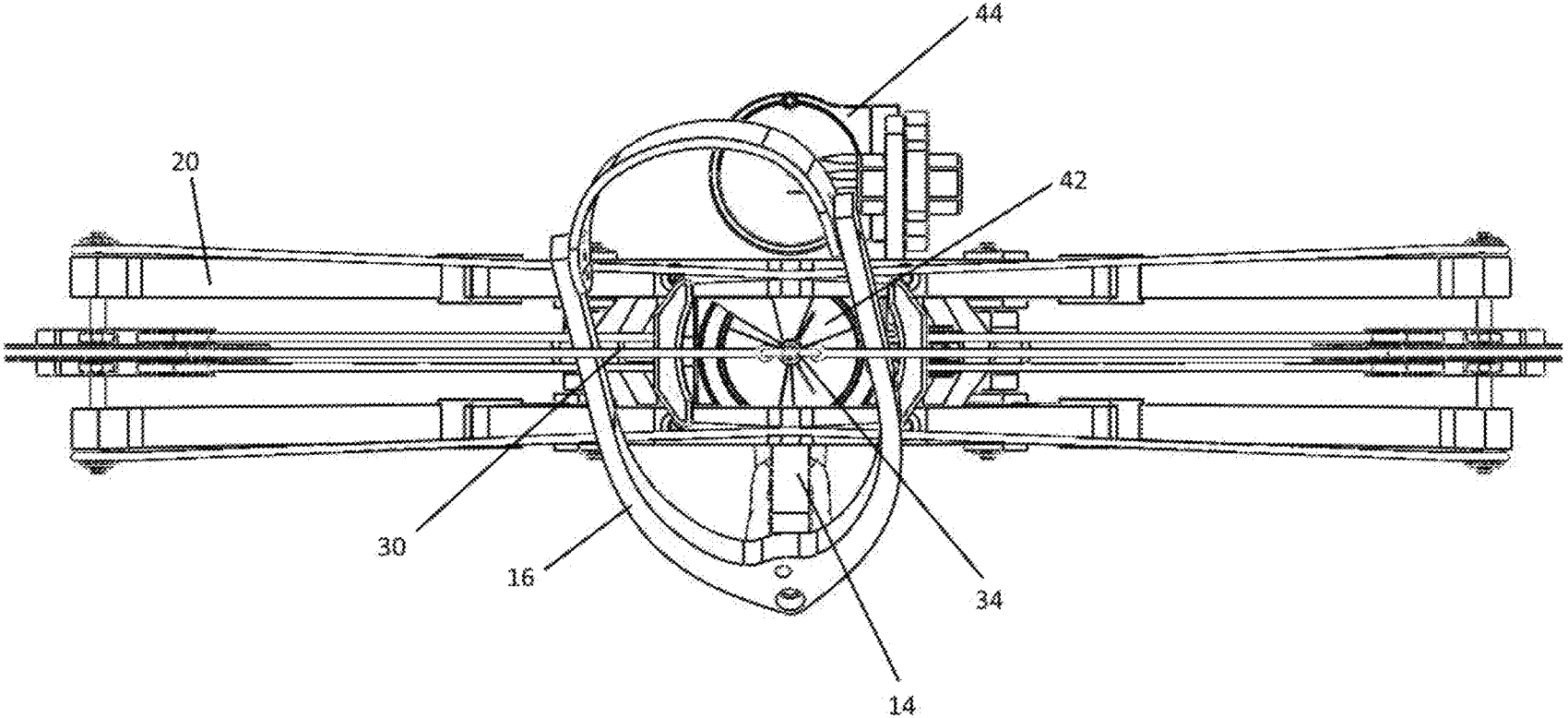
FIG. 7 illustrates a rear perspective view image of the present invention.

FIG. 7 illustrates a rear perspective view of the present invention. The arrow rest 42, clearly visible in this view, is directly behind the nock point 34. The sight 44, handle 14, bowstring 30, arm brace 16, split limbs 20, and other components are also displayed.

Figure 8:
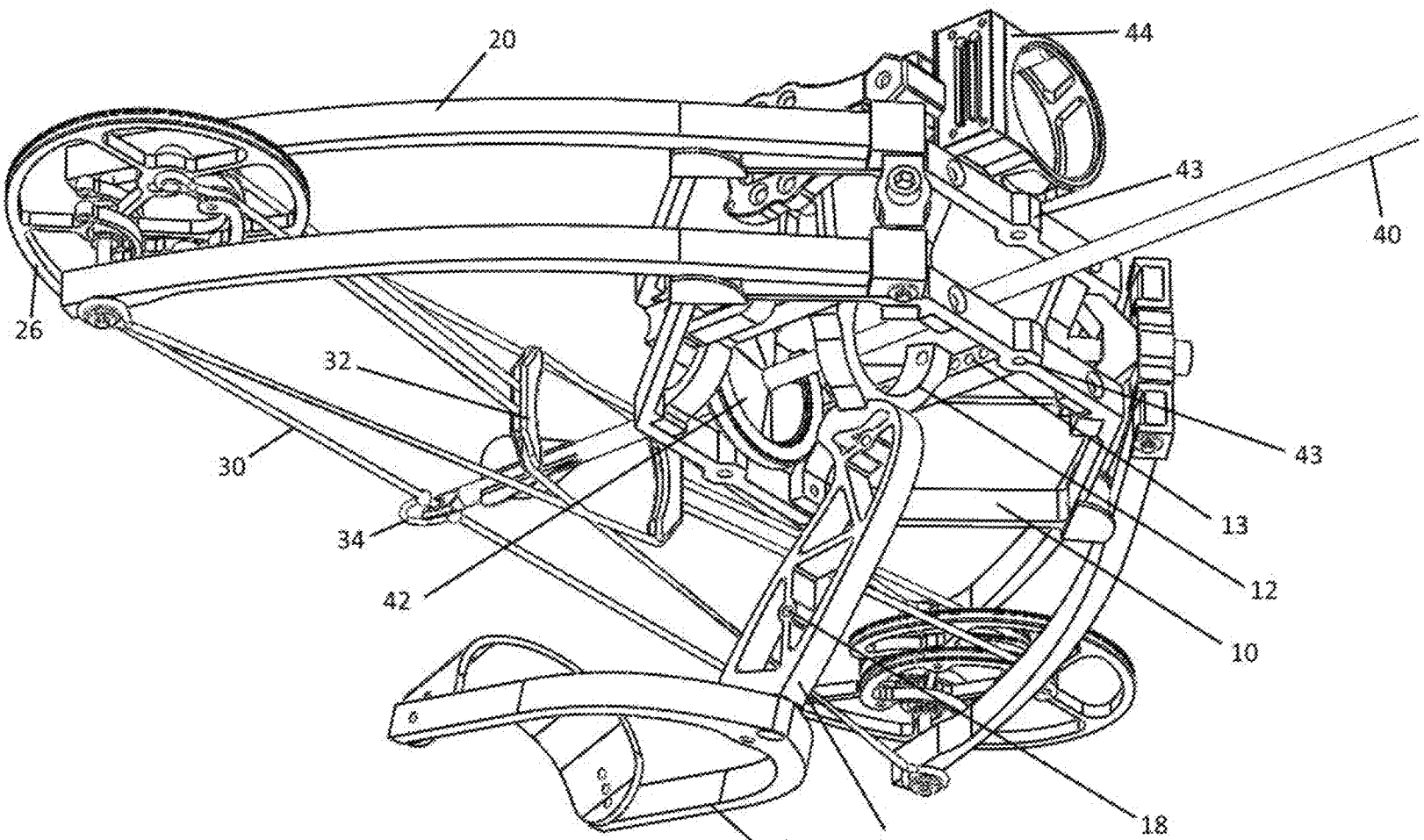
FIG. 8 illustrates a bottom-right perspective view image of the present invention.

FIG. 8 illustrates a bottom-right perspective view image of the present invention. The grip screw threads 18 are clearly visible in this view. The grip screws attach the grip to the handle frame, thus allowing custom grip assembly. An archer may add a custom wood or synthetic grip, or use the custom grip assembly without adding a grip. The riser 10, yoke 12, pivot attachment holes 13, handle 14, arm brace 16, split limbs 20, cam pulleys 26, bowstring 30, cable spreaders 32, nock point 34, arrow 40, arrow rest 42, accessory mounts 43, and sight 44 are depicted in this view.

Figure 9:
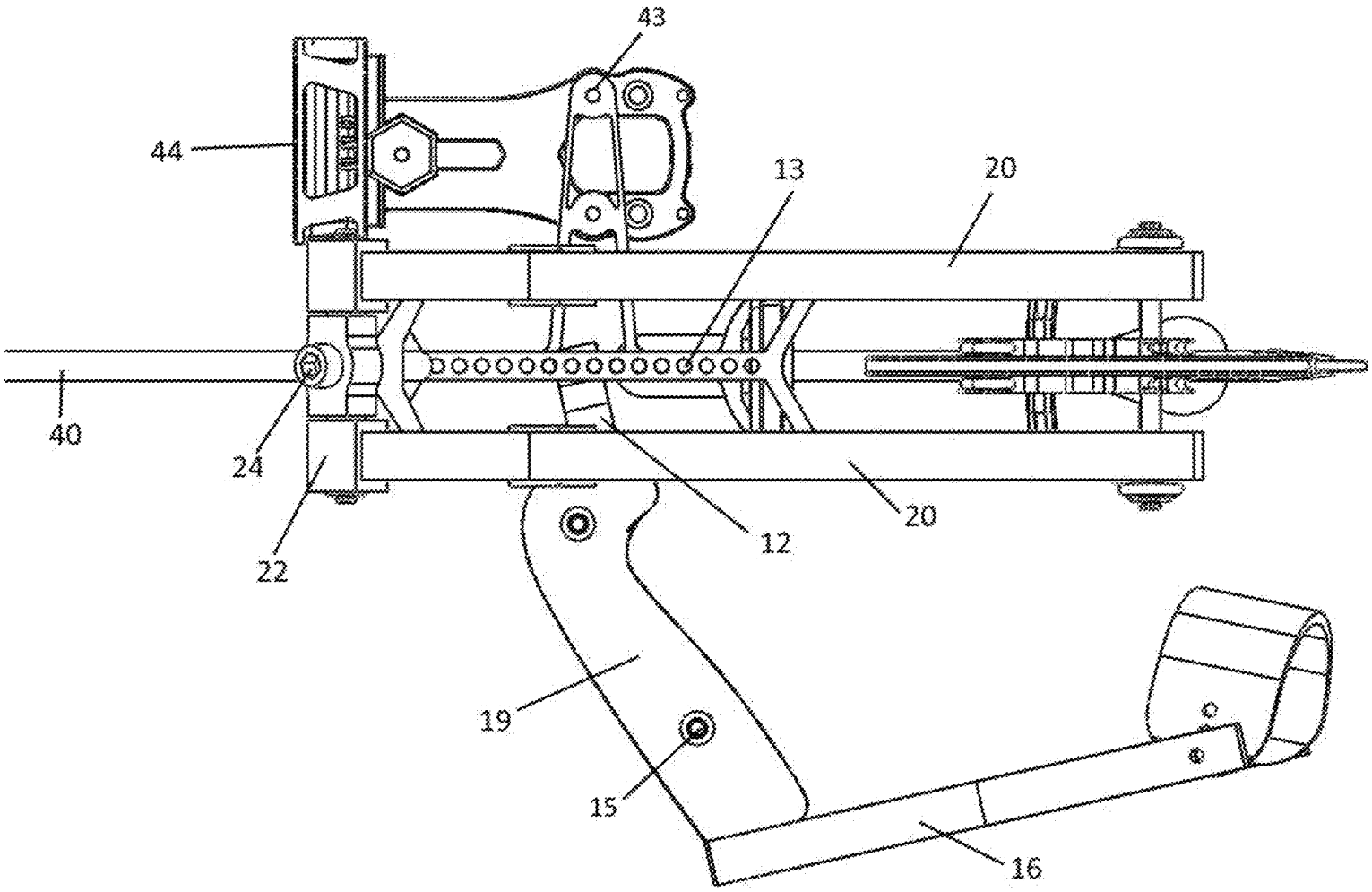
FIG. 9 illustrates a left side perspective view image with the handle extended of the present invention.

FIG. 9 illustrates a left side perspective view of the present invention with a handle grip 19 covering the handle, with the handle grip 19 being held in place by grip screw 15 inserted into the grip screw threads. The yoke 12, pivot adjustment holes 13, arm brace 16, split limbs 20, limb pockets 22, limb adjustment screw 24, arrow 40, and sight 44 are depicted in this view.

Figure 10:
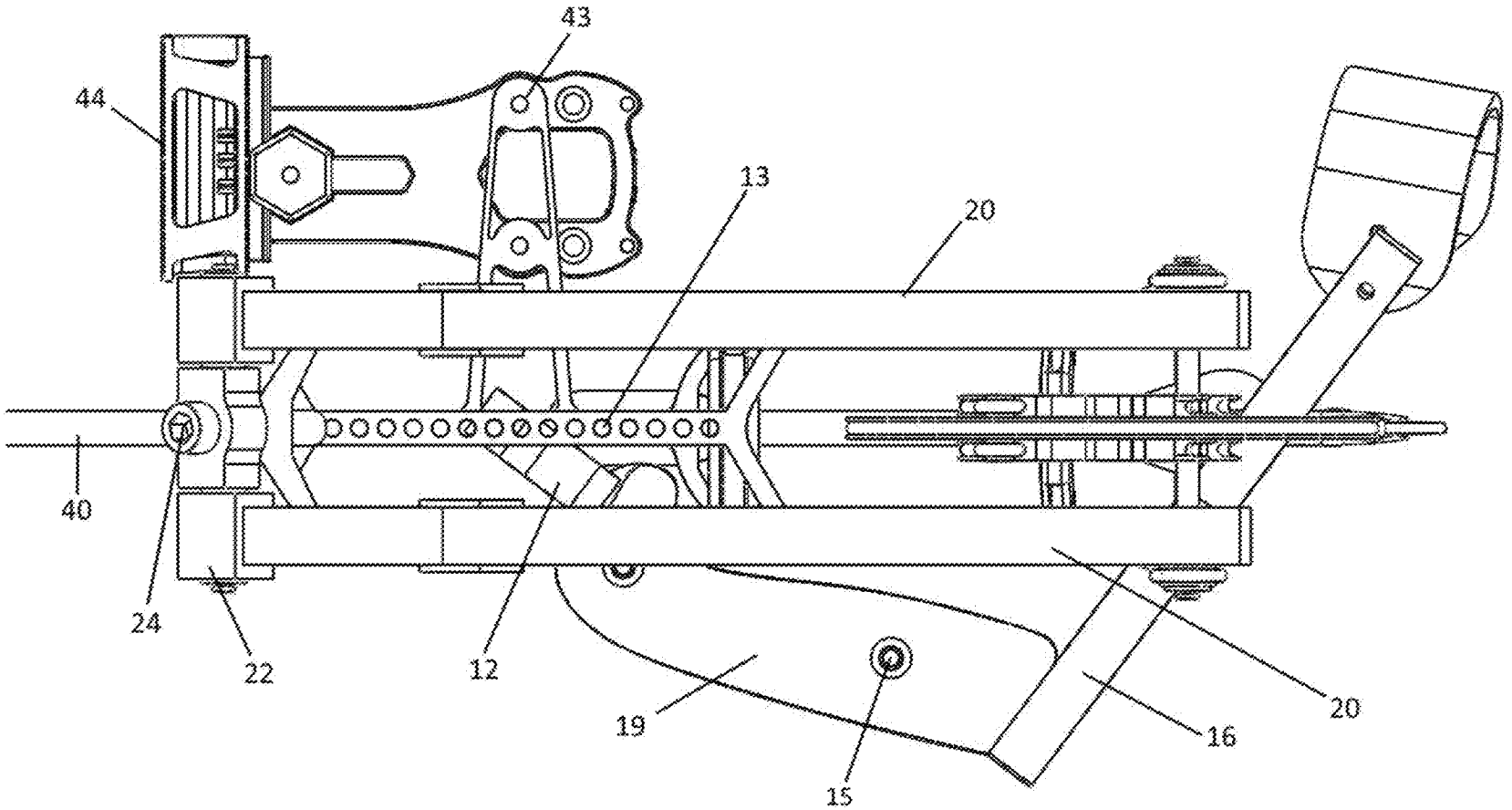
FIG. 10 illustrates a left side perspective view image with the handle collapsed of the present invention.

FIG. 10 illustrates a left side perspective view image with the handle collapsed of the present invention. A handle grip 19 covers the handle, with the handle grip 19 being held in place by grip screw 15 inserted into the grip screw threads. The yoke 12, pivot adjustment holes 13, arm brace 16, split limbs 20, limb pockets 22, limb adjustment screw 24, arrow 40, and sight 44 are depicted in this view.

Figure 11:
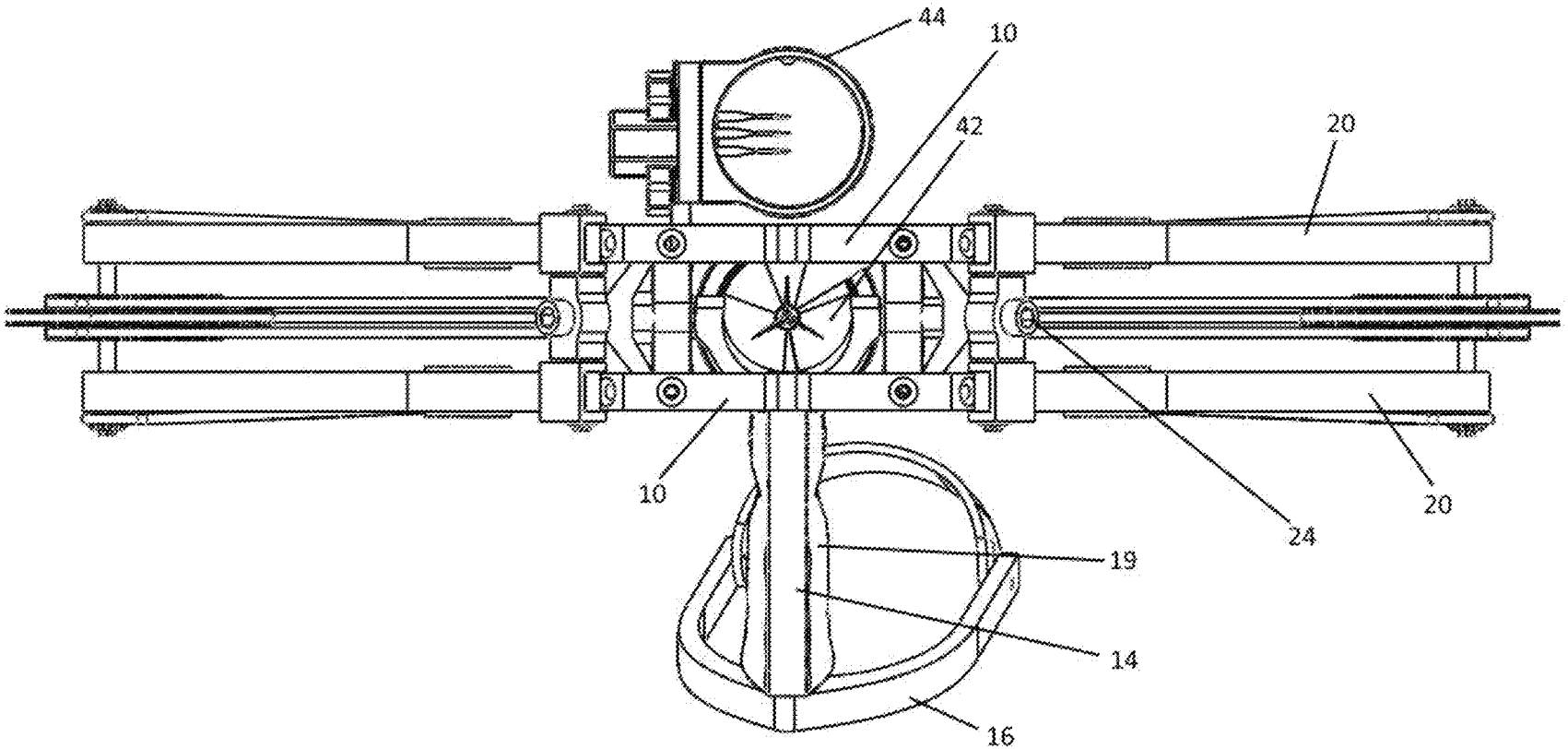
FIG. 11 illustrates a front perspective view image of the present invention.

FIG. 11 illustrates a front perspective view of the present invention. An arrow rest 42 is removably attached to the riser 10. A sight 44 is removably attached to the riser 10. The riser 10, handle 14, arm brace 16, handle grip 19, split limbs 20, and limb adjustment screw 24 are also depicted in this view.

Figure 12:
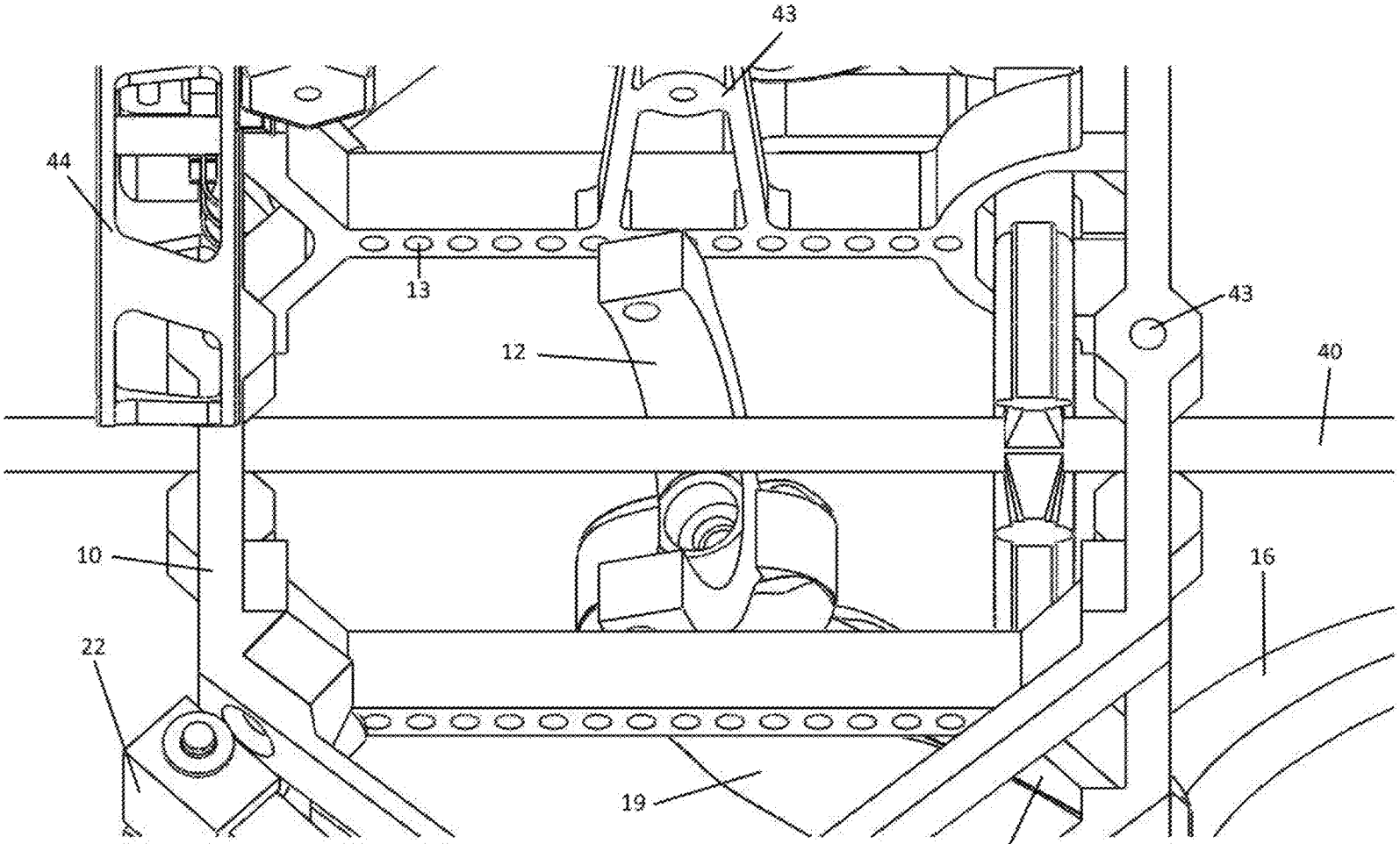
FIG. 12 illustrates a top-left perspective view image of the handle connection of the present invention.

FIG. 12 illustrates a top perspective view focused on the yoke 12, which is inserted into the riser 10, and is adjustably movable from the front to the back of the riser using the pivot adjustment holes 13. The arm brace 16, arrow 40, accessory mount 43, a limb pocket 22, and handle 14 can also be seen in this view.

Figure 13:
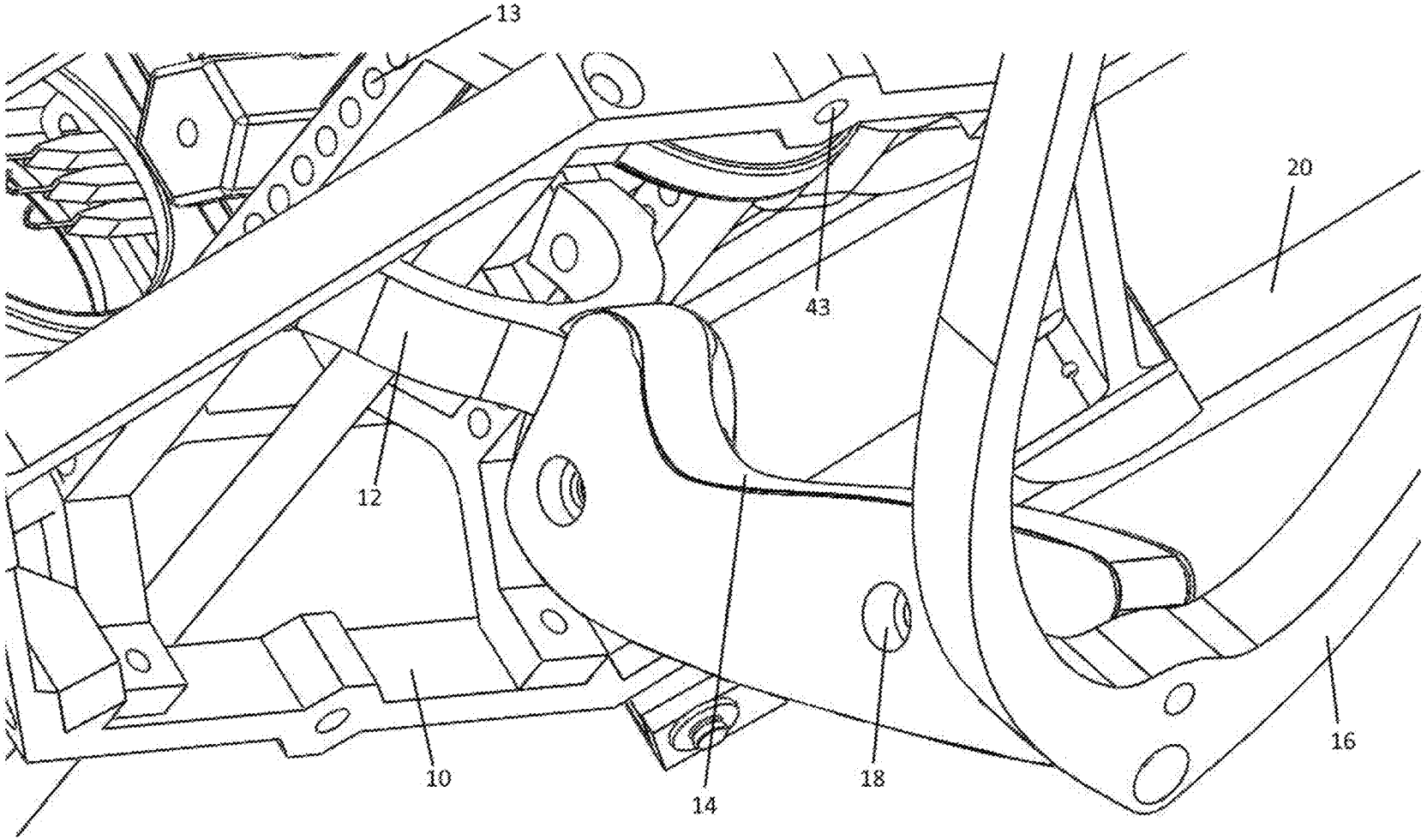
FIG. 13 illustrates a left-bottom-rear perspective view image of the riser and handle connection of the present invention.

FIG. 13 illustrates a left-bottom-rear perspective view image of the riser and handle connection of the present invention. A yoke 12 is inserted into the riser 10, and is adjustably movable from the front to the back of the riser. The arm brace 16, split limbs 20, accessory mount 43, and handle 14 can also be seen in this view.

Figure 14:
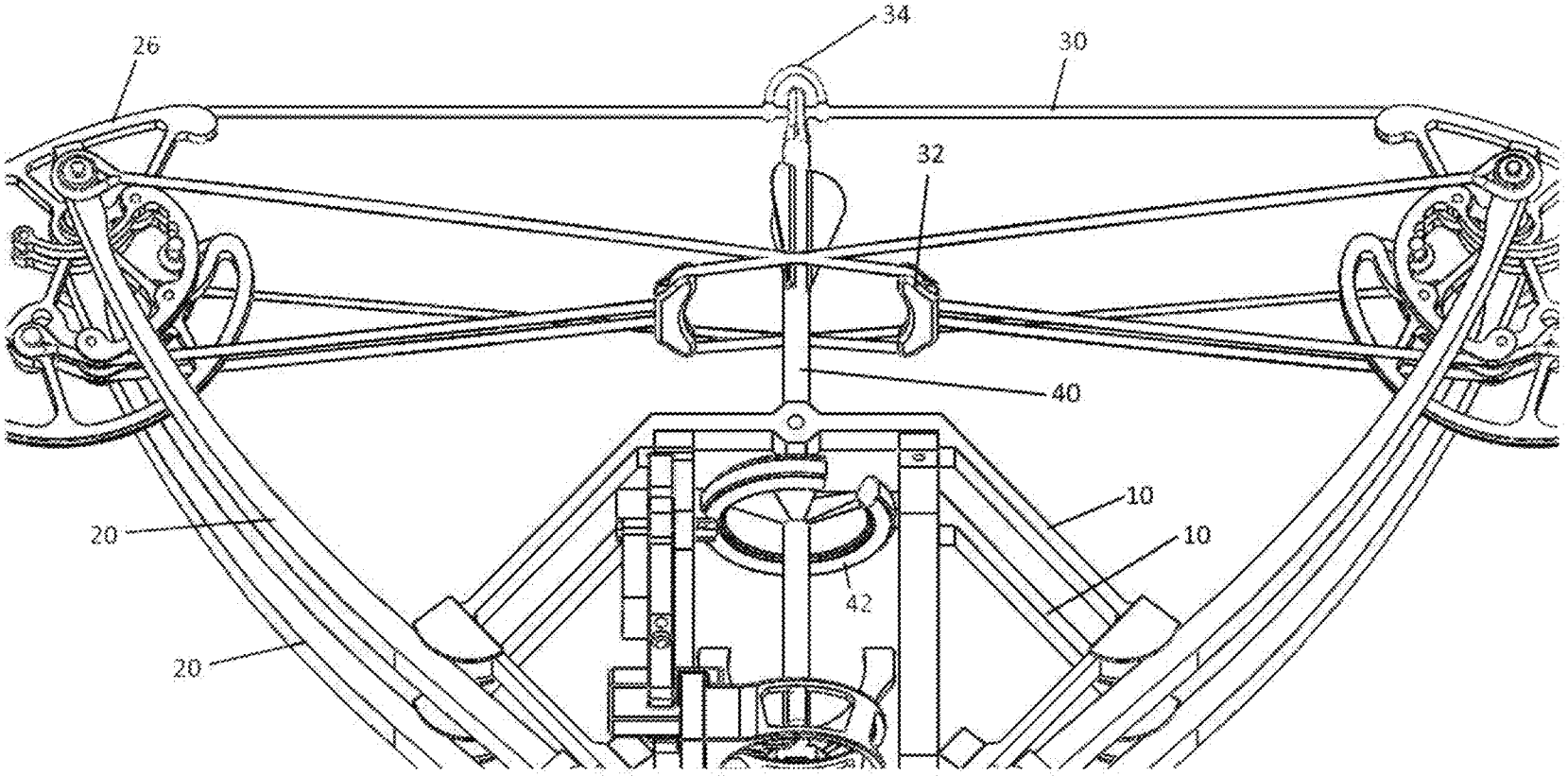
FIG. 14 illustrates a close, top-front perspective view image of the undrawn bowstring and cable spreaders of the present invention.

FIG. 14 illustrates a front, top perspective view of the present invention focused on the window created by the cable spreaders 32. A nock point 34 is in the background. The riser 10, arrow 40, split limbs 20, cam pulleys 26, bowstring 30, and arrow rest 42 are also depicted in this view.

Figure 15:
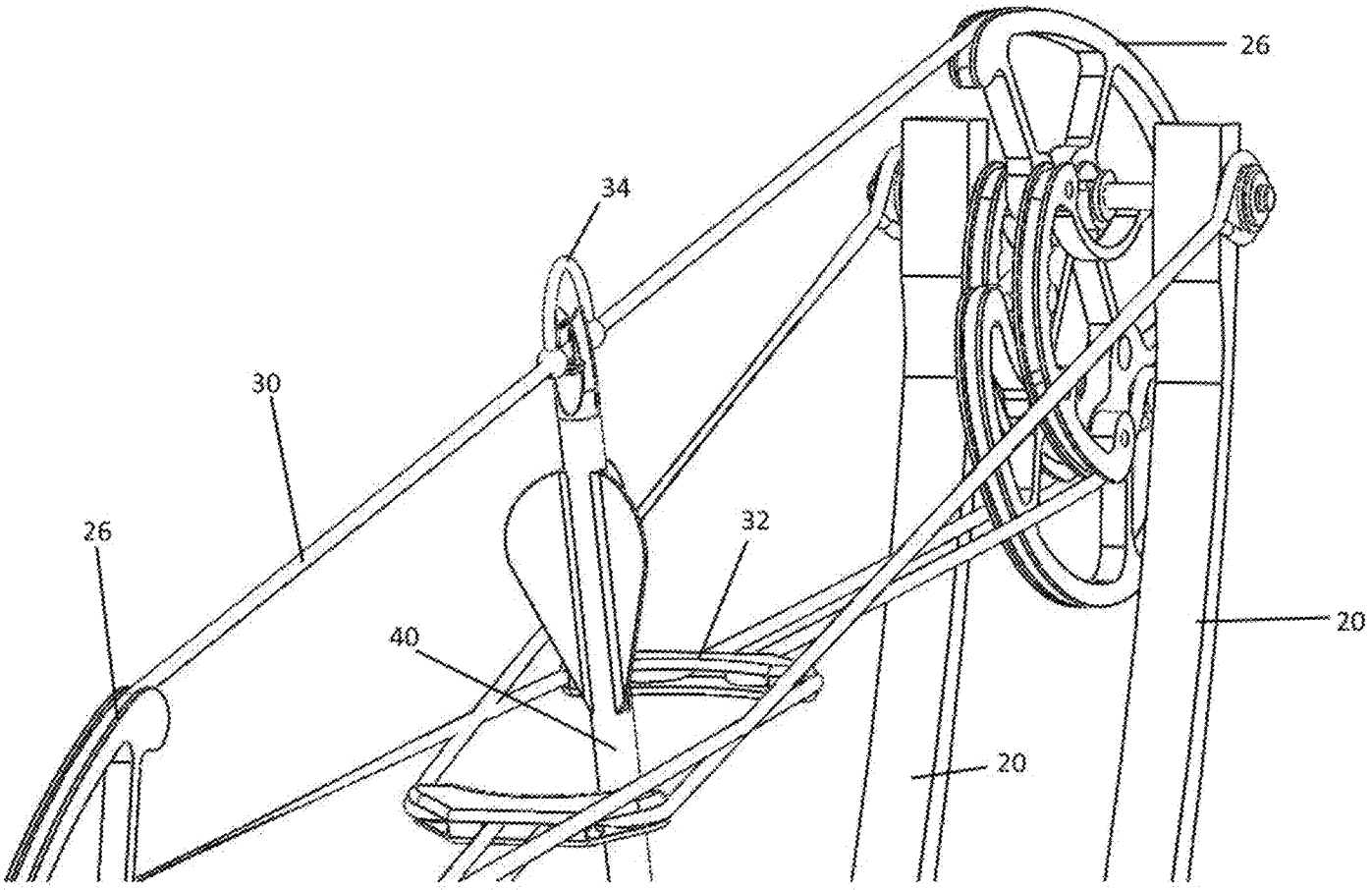
FIG. 15 illustrates a close, right-rear perspective view image of the undrawn bowstring and cable spreaders of the present invention.

FIG. 15 illustrates a close, left-rear perspective view image focused on the window created by the cable spreaders 32. A nock point 34 is above. In the background, is a cam pulley 26. The cable spreaders feed cables into the cam pulleys 26 and spread the cables for the arrow to shoot through. The bowstring 30, arrow 40, and split limbs 20 are also depicted in this view.

Figure 16:
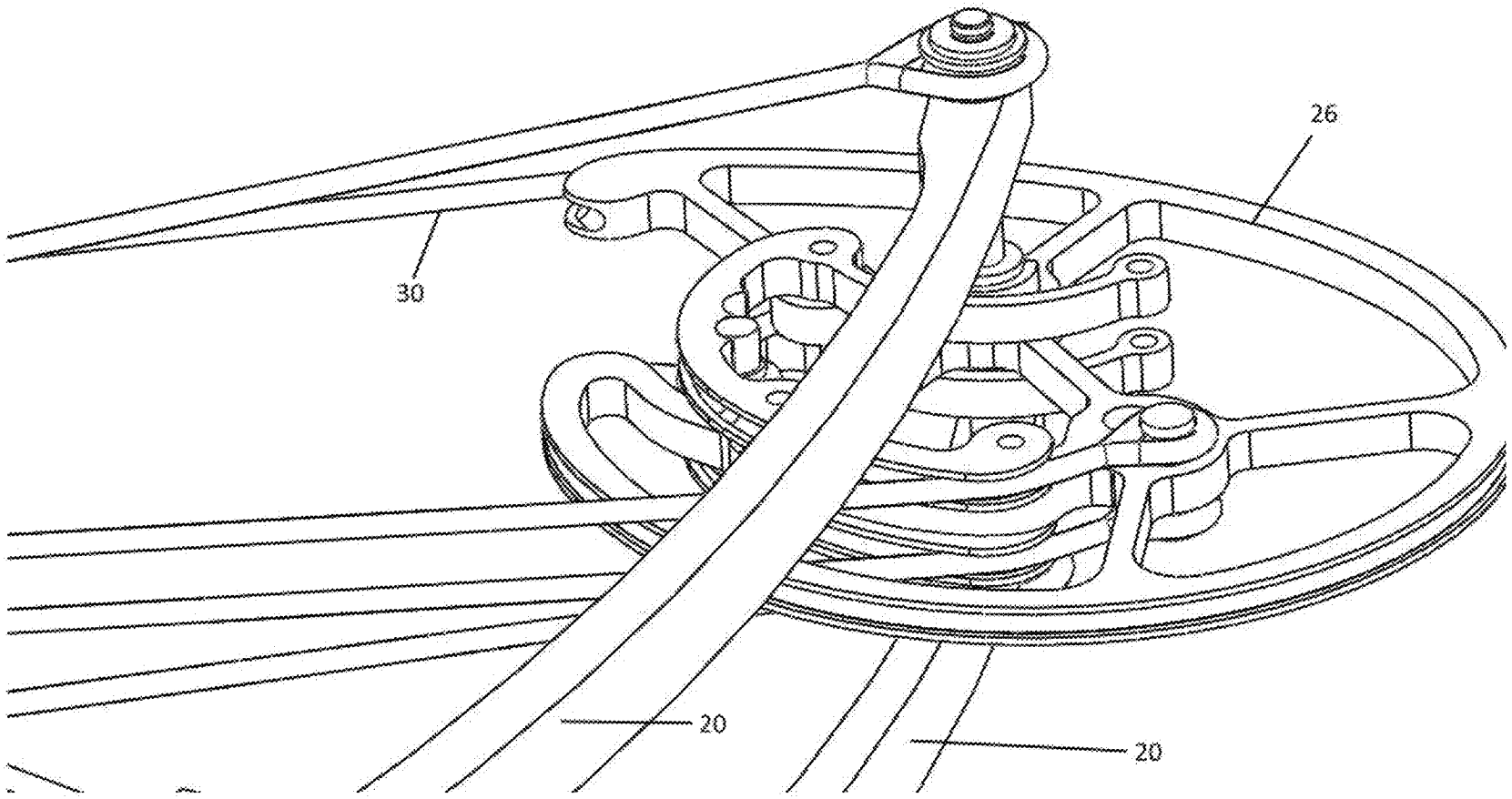
FIG. 16 illustrates a top-front perspective view image of a cam pulley of the present invention.

FIG. 16 illustrates a cam pulley 26 of the present invention. The bowstring 30 is wrapped around the cam pulley 26.

The above-mentioned examples are provided to serve the purpose of clarifying the aspects of the invention, and it will be apparent to one skilled in the art that they do not serve to limit the scope of the invention. By way of example, the handle may pivot in multiple axes. Also by way of example, the limbs may be solid. By nature, this invention is highly adjustable, customizable and adaptable. The above-mention examples are is just some of the many configurations that the mentioned components can take on. All modifications and improvements have been deleted herein for the sake of conciseness and readability but are properly within the scope of the present invention.

What is claimed is:

1. A mechanical projectile device comprising:

a top pair of flexible members and a bottom pair of flexible members, each flexible member having a first end and a second end;

a cam pulley system including cam pulleys and at least one cable;

a bowstring including a nock point;

a handle including a top end a bottom end, wherein the top end of the handle is a yoke and the bottom end of the handle is connected to an arm brace; and a horizontal structural riser including:

a pair of pivot bars including a left pivot bar and a right pivot bar, each pivot bar having a top, a bottom, a front end, a back end, two sides, and means for adjusting the handle yoke along the pivot bars;

a pair of front mounting brackets including a left front mounting bracket and a right front mounting bracket, wherein the front end of the left pivot bar is attached to the left front mounting bracket and the front end of the right pivot bar is attached to the right front mounting bracket;

a pair of back mounting brackets including a left back mounting bracket and a right back mounting bracket, wherein the back end of the left pivot bar is attached to the left mounting bracket and the back end of the right pivot bar is attached to the right mounting bracket;

a top riser plate having an inside, an outside, a front half, a back half, a top, and a bottom;

a bottom riser plate having an inside, an outside, a front half, a back half, a top, and a bottom, wherein the bottom riser plate is parallel to the top riser plate and the top of the bottom riser plate faces the bottom of the top riser plate;

wherein the pair of front mounting brackets are affixed to the front half of the top riser plate and the pair of front mounting brackets are affixed to the front half of the bottom riser plate;

wherein the pair of back mounting brackets are affixed to the back half of the top riser plate and the pair of back mounting brackets are affixed to the back half of the bottom riser plate;

wherein the top of each pivot bar faces the bottom of the top riser plate and the bottom of each pivot bar faces the top of the bottom riser plate;

wherein the first end of each flexible member of the top pair of flexible members is affixed to the front half of the top riser plate;

wherein the first end of each flexible member of the bottom pair of flexible members is affixed to the front half of the bottom riser plate on the outside of the bottom riser plate;

wherein the cam pulleys are rotationally affixed between the top pair of flexible members and the bottom pair of flexible members via affixation between the second ends of each of the flexible members;

wherein the at least one cable is wrapped around at least a portion of the cam pulleys;

wherein the bowstring is wrapped around at least a portion of the cam pulleys; and wherein the handle is pivotally mounted via the handle yoke to the pair of pivot bars such that the handle is adjustable among a plurality of positions via movement of the handle yoke to adjust the draw length of the bow.

2. The mechanical projectile device of claim 1, wherein the handle pivots about an axis parallel to the horizontal structural riser.

3. The mechanical projectile device of claim 1, wherein the handle pivots about an axis perpendicular to the horizontal structural riser.

4. The mechanical projectile device of claim 1, wherein the arm brace is rotatable about the bottom end of the handle from a home position through a plurality of positions which accommodate left-handedness and right-handedness, wherein when the arm brace is in the home position, the handle, the arm brace, the handle yoke, and the horizontal structural riser are symmetrical relative to a vertical plane which bisects the handle, the arm brace, the handle yoke, and the horizontal structural riser.

5. The mechanical projectile device of claim 1, wherein the handle yoke is pivotally mountable between the pair of pivot bars via a plurality of holes on each pivot bar.

6. The mechanical projectile device of claim 1, wherein the handle yoke includes an offset pivot point for pivotally mounting the handle yoke between the pair of pivot bars, wherein the handle yoke is forwardly and reversibly mountable between the pair of pivot bars via the offset pivot point, and wherein forwardly mounting the handle yoke at a location between the pair of pivot bars provides a different draw length from reversibly mounting the handle yoke at the location between the pair of pivot bars.

7. The mechanical projectile device of claim 1, wherein no components of the mechanical projectile device are positioned in a horizontal plane between the pair of pivot bars, such that no components of the mechanical projectile device obstruct horizontal movement of the handle among the plurality of positions via movement of the handle yoke.

8. The mechanical projectile device of claim 1, wherein the top end of the handle further includes a biaxial gimbal, wherein the biaxial gimbal is connected to the handle yoke and the biaxial gimbal provides for the handle to rotate with respect to two axes.

9. The mechanical projectile device of claim 1, wherein the top end of the handle further includes a triaxial gimbal, wherein the triaxial gimbal is connected to the handle yoke and the triaxial gimbal provides for the handle to rotate with respect to three axes.

10. A mechanical projectile device comprising:

first and second limb pairs, each limb pair having a top limb and a bottom limb having a first end and a second end;

a bowstring including a nock point;

a handle including a top end and a bottom end, wherein the top end of the handle has a yoke; and a horizontal structural riser including:

a pair of pivot bars including a left pivot bar and a right pivot bar, each pivot bar including a top, a bottom, a front end, a back end, two sides, and means for attaching the handle yoke along the pivot bars;

a pair of front mounting brackets including a left front mounting bracket and a right front mounting bracket, wherein the front end of the left pivot bar is attached to the left front mounting bracket and the front end of the right pivot bar is attached to the right front mounting bracket;

a pair of back mounting brackets including a left back mounting bracket and a right back mounting bracket, wherein the back end of the left pivot bar is attached to the left mounting bracket and the back end of the right pivot bar is attached to the right mounting bracket;

a top riser plate having an inside, an outside, a front half, a back half, a top, and a bottom;

a bottom riser plate having an inside, an outside, a front half, a back half, a top, and a bottom, wherein the bottom riser plate is parallel to the top riser plate and the top of the bottom riser plate faces the bottom of the top riser plate;

wherein the pair of front mounting brackets are perpendicularly and symmetrically affixed to the front half of the top riser plate and are perpendicularly and symmetrically affixed to the front half of the bottom riser plate;

wherein the pair of back mounting brackets are perpendicularly and symmetrically affixed to the back half of the top riser plate and are perpendicularly and symmetrically affixed to the back half of the bottom riser plate;

wherein the top of each pivot bar faces the bottom of the top riser plate and the bottom of each pivot bar faces the top of the bottom riser plate;

wherein the first end of each top limb of the first and second limb pairs is affixed to the top riser plate;

wherein the first end of each bottom limb of the first and second limb pairs is affixed to the bottom riser plate;

wherein the bowstring is attached to one or more pulleys adjacent to the second end of each limb; and wherein the handle yoke is pivotally mountable between the pair of pivot bars such that the mechanical projectile device provides for a variety of draw lengths via horizontal movement and pivotal mounting of the handle yoke between the pair of pivot bars, wherein the variety of draw lengths includes a longest draw length and a shortest draw length.

11. The mechanical projectile device of claim 10, further comprising an arm brace connected to the bottom end of the handle, wherein the arm brace is rotatable about the bottom end of the handle from a home position through a plurality of positions which accommodate left-handedness and right-handedness, wherein when the arm brace is in the home position, the handle, the arm brace, the handle yoke, and the horizontal structural riser are symmetrical relative to a vertical plane which bisects the handle, the arm brace, the handle yoke, and the horizontal structural riser.

12. The mechanical projectile device of claim 10, wherein each pivot bar includes a multiplicity of holes disposed between the two sides of each pivot bar, wherein the handle yoke is pivotally mountable between the pair of pivot bars via the multiplicity of holes disposed between the two sides of each pivot bar such that the mechanical projectile device provides for the variety of draw lengths via horizontal movement and pivotal mounting of the handle yoke between the pair of pivot bars.

13. The mechanical projectile device of claim 10, wherein the handle pivots about an axis parallel to the horizontal structural riser.

14. The mechanical projectile device of claim 10, wherein the handle pivots about an axis perpendicular to the horizontal structural riser.

15. The mechanical projectile device of claim 10, wherein no components of the mechanical projectile device are positioned in a horizontal plane between the pair of pivot bars, such that no components of the mechanical projectile device obstruct horizontal movement of the handle yoke of the handle between the pair of pivot bars.

16. The mechanical projectile device of claim 10, wherein the handle yoke includes an offset pivot point for pivotally mounting the yoke between the pair of pivot bars, wherein the handle yoke is forwardly and reversibly mountable between the pair of pivot bars via the offset pivot point, and wherein forwardly mounting the handle yoke at a location between the pair of pivot bars provides a different draw length from reversibly mounting the handle yoke at the location between the pair of pivot bars.

17. A mechanical projectile device comprising:

limbs, each limb having a first end and a second end;

a bowstring including a nock point;

a handle including a top end and a bottom end, wherein the top end of the handle has a yoke; and a horizontal structural riser including:

a pair of pivot bars including a left pivot bar and a right pivot bar, each pivot bar including a top, a bottom, a front end, a back end, two sides, and means for attaching the handle yoke along the pivot bars;

a pair of front mounting brackets including a left front mounting bracket and a right front mounting bracket, wherein the front end of the left pivot bar is attached to the left front mounting bracket and the front end of the right pivot bar is attached to the right front mounting bracket;

a pair of back mounting brackets including a left back mounting bracket and a right back mounting bracket, wherein the back end of the left pivot bar is attached to the left mounting bracket and the back end of the right pivot bar is attached to the right mounting bracket;

a top riser plate having an inside, an outside, a front half, a back half, a top, and a bottom; a bottom riser plate having an inside, an outside, a front half, a back half, a top, and a bottom, wherein the bottom riser plate is parallel to the top riser plate and the top of the bottom riser plate faces the bottom of the top riser plate;

wherein the pair of front mounting brackets are perpendicularly and symmetrically affixed to the front half of the top riser plate and are perpendicularly and symmetrically affixed to the front half of the bottom riser plate;

wherein the pair of back mounting brackets are perpendicularly and symmetrically affixed to the back half of the top riser plate and are perpendicularly and symmetrically affixed to the back half of the bottom riser plate;

wherein the top of each pivot bar faces the bottom of the top riser plate and the bottom of each pivot bar faces the top of the bottom riser plate;

wherein the bowstring is attached to one or more pulleys adjacent to the second end of each limb; and wherein the handle yoke is pivotally mountable between the pair of pivot bars such that the mechanical projectile device provides for a variety of draw lengths via horizontal movement and pivotal mounting of the handle yoke between the pair of pivot bars, wherein the variety of draw lengths includes a longest draw length and a shortest draw length.

* * * * *